US005176057A

United States Patent [19]

Chun et al.

[11] Patent Number: 5,176,057

[45] Date of Patent: Jan. 5, 1993

[54] PUNCH HOLDER WITH STRIPPER ARRANGEMENT

[75] Inventors: Victor L. Chun, Holland; Charles E. Butz, Aston, both of Pa.

[73] Assignee: Murata Machinery Limited, Aichi, Japan

[21] Appl. No.: 775,213

[22] Filed: Oct. 11, 1991

[51] Int. Cl.[5] ..... B21D 45/08; B26F 1/14

[52] U.S. Cl. ..... 83/139; 83/140; 83/698

[58] Field of Search ..... 83/138, 139, 140, 141, 83/142, 143, 684, 685, 686, 552, 698

[56] References Cited

U.S. PATENT DOCUMENTS

| | | | |
|---|---|---|---|
| 2,867,276 | 1/1959 | Taylor | 83/139 |
| 3,530,750 | 9/1970 | Daniels | 83/698 X |
| 3,670,613 | 6/1972 | Rienzi | 83/139 |
| 4,041,817 | 8/1977 | Nelson | 83/139 |
| 4,646,599 | 3/1987 | Benedict | 83/140 X |
| 4,929,276 | 5/1990 | Chun et al. | 83/139 X |
| 4,989,484 | 2/1991 | Johnson et al. | 83/140 |
| 5,056,391 | 10/1991 | Stewart | 83/139 |

*Primary Examiner*—Douglas D. Watts
*Assistant Examiner*—Eugenia A. Jones
*Attorney, Agent, or Firm*—John R. Benefiel

[57] ABSTRACT

A punch holder is described having a stripper arrangement composed of an annular array of nested coil springs housed within a series of aligned facing bores in a punch holder tang and punch holder body to generate a high stripping force in a compact space. A threaded removal ring is employed to force a press fitted stripper cap off the end of the punch holder body. A support ring can be employed to support the stripping cap for small sized punches, or a metal reinforcement molded into the stripper cap.

10 Claims, 4 Drawing Sheets

PUNCH HOLDER WITH STRIPPER ARRANGEMENT

BACKGROUND OF THE INVENTION

This invention concerns punch holders, and more particularly punch holders for use in turret punch presses where a number of holders are carried by rotary turrets for selective engagement of the press ram with one of the punch holders. A stripping arrangement is necessary to be incorporated allowing the punch to be withdrawn after the workpiece has been punched without lifting of the workpiece as the punch, tightly fit to the punched hole, is retracted. Lifting of the workpiece degrades the quality of the punched hole, as well as other problems well known in the art.

The necessary stripping force levels, typically created by springs, can be considerable, particularly for thicker workpieces, and lifting of the workpiece often occurs notwithstanding the inclusion of a stripper arrangement.

Prior stripper arrangements have not allowed completely adequate stripper spring forces, particularly for holders for turret punch presses which are of relatively compact design. The springs cannot be overly stressed or their service life is excessively shortened. A typical multiple spring stripper uses a series of studs, each mounting an individual spring, this arrangement being relatively bulky. See U.S. Pat. No. 3,496,818 for an example of this type. Belleville washer sets have also been used, but while relatively compact, have not resulted in completely adequate stripper force levels.

A stripper plate is typically included in the prior art stripper arrangements, the stripper plate directly bearing against the workpiece surface, under the pressure of the stripper springs used to generate the stripping force.

The stripper plate has an opening closely fit to the punch for the most effective stripping.

The stripper plate sometimes needs to be of a relatively soft material such a brass or urethane plastic to avoid marring of the surface of the workpiece. The stripper plate thus needs to be changed with a change in workpiece material, and may be constructed of a variety of materials such as brass, plastic, steel, with an opening closely fit to the particular punch.

SUMMARY OF THE INVENTION

The present invention comprises a punch holder having a compact high force stripper spring arrangement, and which holder also incorporates a readily changeable stripper plate which may be of various materials.

The holder includes a punch holder tang slidably received in a punch holder body, the punch holder tang adapted to have a punch fixed thereto, and to be engaged with the press ram. The punch holder body has a retainer plate affixed to the upper end overlying the top of the punch holder tang.

The punch holder tang and punch holder body have opposing radial faces each formed with an annular array of aligned pockets, with an axial gap between the opposing faces. A series of spring sets, each comprising a nested pair of springs, with a larger diameter spring receiving a smaller diameter spring, are received in the aligned pockets, so as to enable a high stripper force level to be generated by the spring sets, which are supported in the pockets and are unsupported only for the space of the gap between the opposing holder tang and body surfaces.

In an alternate embodiment, a cylindrical elastomeric member is formed with annular holes receiving metallic springs, the entire assembly compressed during punching to generate high stripping forces in a compact space.

A stripper cup is received over the lower end of the punch holder body and held with a press fit with an O-ring disposed over the diameter of the end of punch holder body, allowing ready replacement.

In an alternate embodiment, a threaded ring is employed to force the stripper cup off as an aid to convenient changing of the stripper cup.

A backup ring may be received in a counterbore provided to accommodate large diameter punch heads, the backing ring providing stripper cup support for smaller sized punches.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
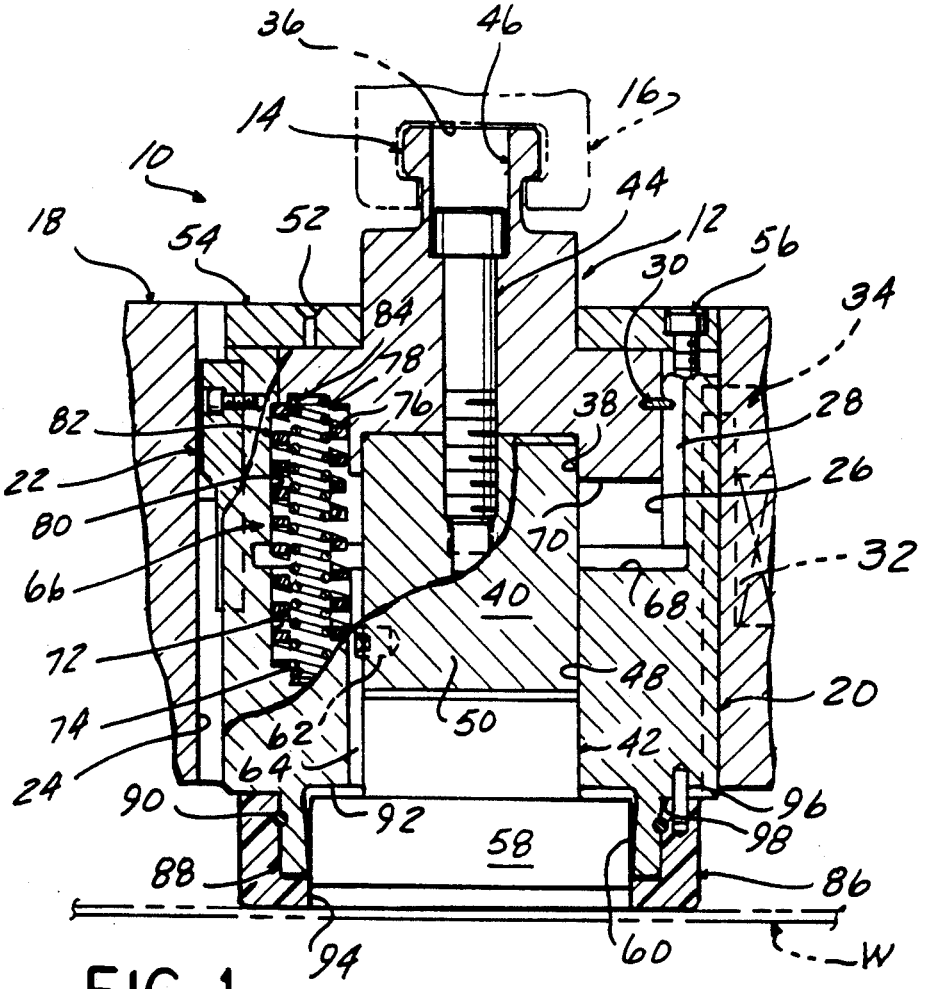
FIG. 1 is a partial section view of a punch holder incorporating a stripper arrangement according to the present invention.
Figure 2:
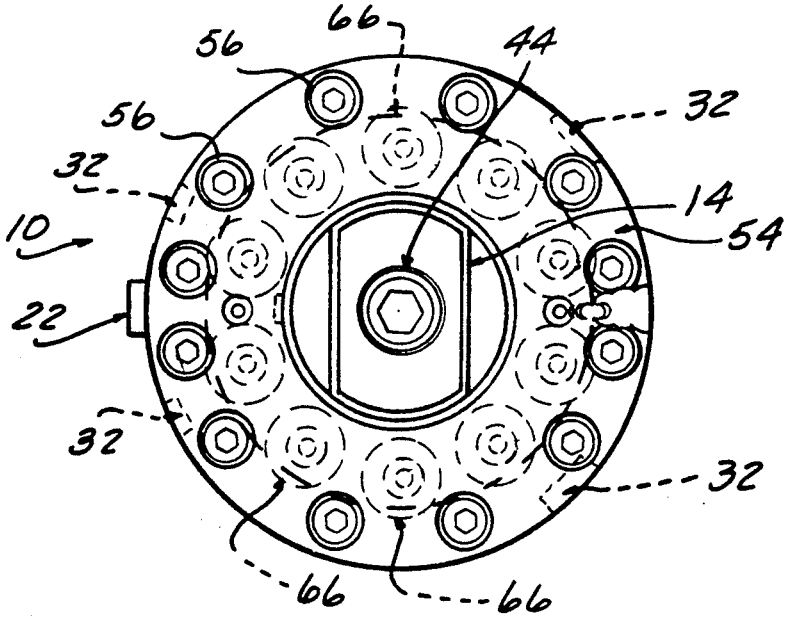
FIG. 2 is an end view of the punch holder shown in FIG. 1.

FIGS. 1 and 2 show the punch holder 10, which includes a punch holder tang 12 having a tee head 14 adapted to move into mating engagement with a press ram 16 as the press turret 18 rotates to bring a particular holder 10 beneath the ram 16, in the manner well known in the art.

A punch body 20 is fit into a bore in the turret 18, with a key 22 attached mating with a keyway 24 in the turret bore for proper alignment of the holder body 20 (and the complete holder 10). The holder body 20 is formed with a bore 26 which slidably receives the next punch holder tang 12, a slot 28 mating with a radial pin 30 angularly locating the punch holder tang 12 in the punch holder body 20.

Axial slots 32 in the outside of the punch holder body 20 mate with spring loaded lifter fingers 34 to keep the holder 10 in a proper raised position for alignment of the ram tee slot 36.

The punch holder tang 12 is formed with a bore 38 which receives the shank 40 of a punch 42, fixed therein with an axially extending capscrew 44, assembled through an opening 46 in the top of the tee head 14.

The punch shank 40 also extends and is guided in a punch guide bore 48 in the punch holder body 20, the shank 40 having a helical pattern of oil grooves in the outside diameter for allowing flow of lubricant entering through a hole 52 in retainer cap 54 attached with capscrews 56 to the punch holder body 20.

The punch head 58 of the punch 42 shown is enlarged over the diameter of the shank 40, and a counterbore 60 is recessed into the end of the punch holder body 20 to accommodate this enlarged punch head.

A flattened pin 62 is fixed in the punch shank 40 which is received in a slot 64 machined into the base 48 of the punch holder body 20 and serves to properly orient the punch 42 in the punch holder body 20. The flattened pin can also be pressed into the body and mate with a slot cut in the punch shank.

The stripping force is generated by an annular array of stripper spring sets 66. Punch holder body 20 is formed with a radial face 68 facing a radial face 70 of the punch holder tang 12 with a gap therebetween sufficient to accommodate the stroke of the punch 42.

Recessed into each respective face 68, 70 is a series of pockets, receiving the spring sets 66, formed by larger diameter axial bores 72 and concentric smaller diameter axial bores 74 recessed into radial face 68 of the punch holder body 20, and larger diameter axial bores 76 and concentric smaller diameter axial bores 78 recessed into the radial face 70 of the punch holder tang 12, each of the bores 72–78 aligned with the corresponding opposite bore in the punch holder tang 12 and punch holder body 20 respectively. The larger bores 76 in the punch holder tang 12 pass through the outside of the punch holder tang 12.

Each stripper spring set 66 is comprised of the larger diameter springs 82 having each end seated within respective aligned larger diameter bores 72, 76 and the smaller diameter springs 84 having each end seated with respective smaller diameter bores 74 and 78.

The springs 82, 84 are compressed to exert a separating force which is absorbed by the retainer cap 54 affixed to the punch holder body 20.

A stripper cap 86 is received over the outside of the lower end of the punch holder body 20, and a reduced diameter portion 88, with an O-ring 90 held in a groove on the portion 88 and an interior groove in the stripper cap 86 moves into alignment when the stripper cap 86 is fully seated, creating a latching snap action press fit to securely hold the stripper cap 86 in the fully seated position.

A counterbore 92 in the end portion 88 accommodates the larger diameter head of the punch 42.

The stripper cap 86 can be constructed of various materials suited to the particular application, such as brass, urethane plastic or steel, and is formed with an opening 94 closely matched to the punch head 58. A dowel 96 is held in the end face projecting into a bore in the end of a shoulder 98 formed in the punch holder body 20 to orient the stripper cap 86 and insure that opening 94 is turned to match the position of the punch head 58. The dowel can also be retained in cap 86 and inserted into a hole or slot in body 20.

Thus, the punch 10 is initially in the position shown in FIG. 1, with the punch ram 16 in its up position, spring sets 66 urging the punch holder tang 12 up against the cap 54. The holder 10 itself is held up with lifter fingers 34 to be in position so that the tee head 14 will be received in the ram tee slot 36 as the turret 18 is rotated to bring the punch holder 10 into alignment with the ram 16.

As the ram 16 is stroked down until the stripper cap 86 engages the workpiece surface, the punch holder tang 12 moves down, away from cap 54, further compressing the spring sets 66 and exerting a pressure on the workpiece W. The punch 42 thereafter is driven through the workpiece to form a punched hole.

As the ram 16 reverses and is moved up, the spring sets 66 continue to exert a powerful stripping force, holding down the workpiece W as the punch head 58 is pulled from the workpiece W.

The spring sets 66 create a considerable stripping force in a compact space. The facing bores 72–78 provide support over a major proportion of the length of the springs 82, 84, which are further located in a concentric position by the separate concentric large and small diameter bores 72, 74 and 76, 78.

The stripper cap 86 is readily changed at the same time the punch 42 is changed.

Figure 3:
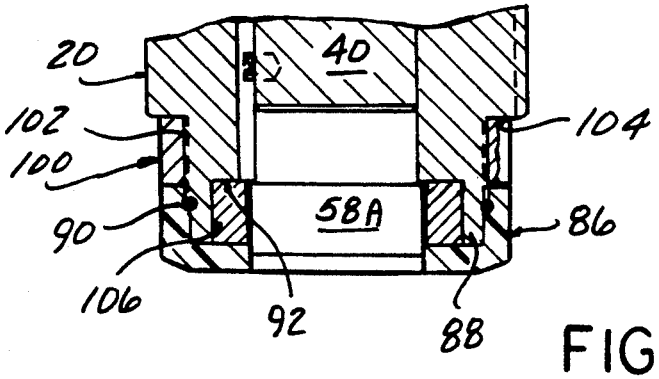
FIG. 3 is an enlarged fragmentary view of the end of a punch holder showing an alternate embodiment of the stripper cup mounting.

FIG. 3 shows a variation in which the stripper cap 86, shown as constructed of plastic, is seated against a threaded removal ring 100, advanced along a threaded section 102 on the lower portion end of the punch holder body 20 and seated against a shoulder 104. The removal ring 100 enables the stripper cap 86 to be forced off as the ring 100 is rotated to be advanced downwardly. This allows a thread removal force to be generated while leaving the cap 86 rotationally stationary which is necessary since the cap 86 may be engaged with a non-round punch head 58B.

A support ring 106 is inserted in the counterbore 92, underlying the end wall of stripper cap 86 extending across the gap between the lower end portion 88 of the punch holder body 20 and the smaller sized punch head 58A.

The support provided by the support ring 106 prevents puckering of the end wall of the stripping cap 86 during stripping which would otherwise occur.

FIGS. 4A–4D illustrate the installation and removal of the stripping cap 86 with the use of the removal ring 100.

Figure 4A:
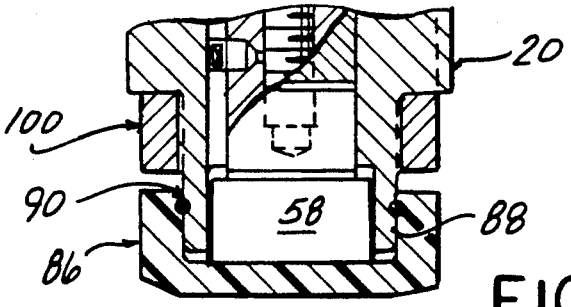
FIGS. 4A–4D are fragmentary sectional views of the end of the punch holder shown in FIG. 3, showing the installation and removal of a plastic stripper cup.

In FIG. 4A the stripper cap 86 initially is not formed with the hole 94, and is shown pushed partially onto the end 88 of the punch holder end 88.

Figure 4B:
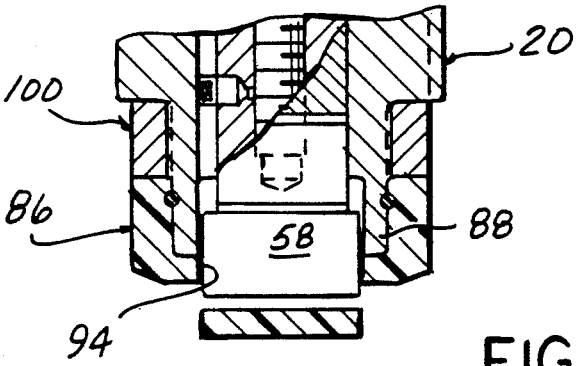
Figure 4C:
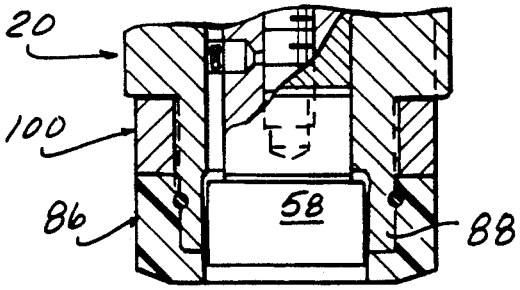

In FIG. 4B the ram is stroked to fully seat the stripper cap 86 against the removal ring 100 and punch hole 94 into the stripper cap, producing a perfect match to the punch head 58, as shown in FIG. 4C.

Figure 4D:
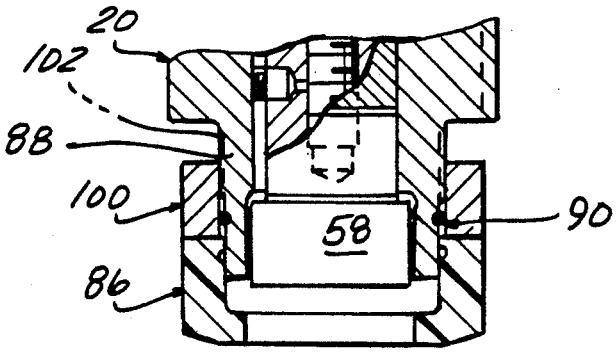

FIG. 4D shows the removal ring 100 being advanced on thread 102, forcing the stripper cap off against the resistance created by the O-ring 90.

Figure 5:
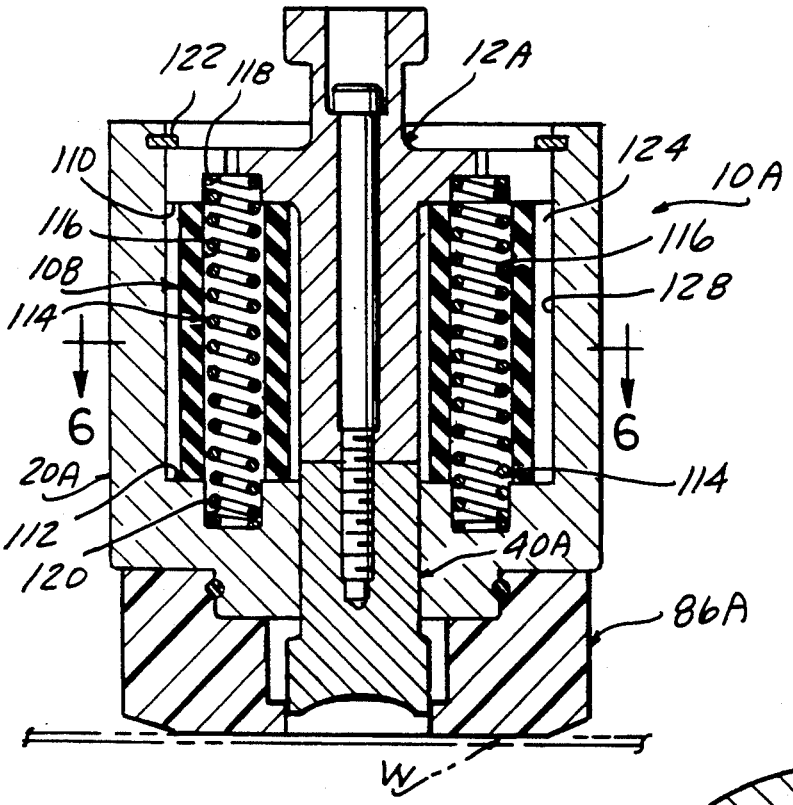
FIG. 5 is a sectional view of an alternate embodiment of the stripper arrangement according to the invention for a punch holder.
Figure 6:
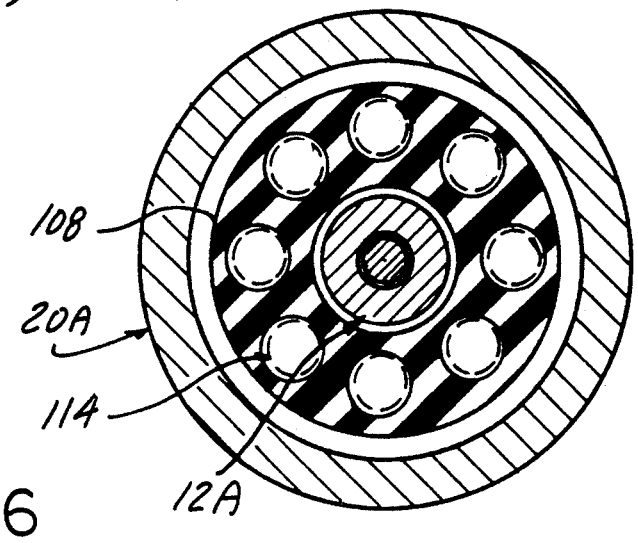
FIG. 6 is a view of the section 6—6 taken in FIG. 5.

FIG. 5 shows another embodiment of a punch holder 10A, utilizing a composite stripper spring comprised of an elastomeric cylinder 108 disposed between a radial face 110 of a punch holder tang 12A and an opposing radial face 112 of a punch holder body 20A.

A helical metallic spring 114 is inserted in each of an annular array of bores 116 and received in bores 118, 120 recessed in radial faces 110, 112 respectively. The springs 114 and elastomeric cylinder 108 are compressed between the punch holder tang 12A and body 20A, with the separating force resisted by a small ring retainer 122.

Thus, a powerful stripping force is generated in a small space as the punch holder tang 12A is stroked downwardly to advance the punch **40*a* with the stripper cap 86A engaging the surface of a workpiece W. A clearance space 124 between the bore 128 in the punch holder body 20A and the elastomeric cylinder 108 accommodates radial deformation of the cylinder 108** as it is compressed.

Figure 7:
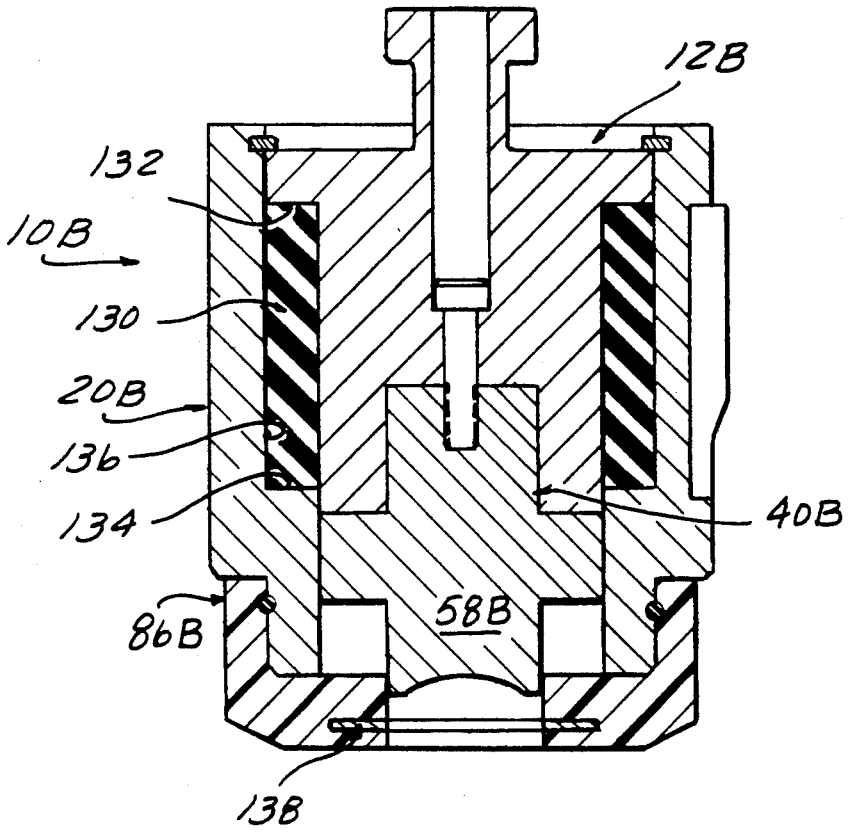
FIG. 7 is a sectional view of yet another alternate embodiment.

FIG. 7 shows yet another embodiment of a holder 1OB, in which a solid elastomeric cylinder 130 is secured between a radial face 132 of a punch holder tang 12B and radial face 134 of punch holder body 20B. The solid elastomeric cylinder 130 completely occupies the annular space between the bore 136 in punch holder body 20B and the outside diameter of the punch holder tang 12B so that a very large stripping force can be generated. Any intermediate stripping force can be tailored by having the elastomeric cylinder partly occupy the annular space and by using different compounds of elastomer.

In this embodiment, the stripper cap 86B is not supported by a backing ring, but rather a stiff metal insert 138 is embedded in the end wall, which resists the puckering effect described above, but which may be punched through to form the opening surrounding the punch head 58B. This construction of the stripper cap may be employed with the above described embodiments.

We claim:

1. A stripper arrangement for a punch holder, said punch holder including a punch holder tang having a tee head formed at an upper end of the punch holder for mating with a press ram tee slot, a punch holder body having a bore formed therein slidably receiving said punch holder tang, said punch holder tang formed with a punch mounting seat for mounting a punch, said punch holder body having a punch guide bore, a punch mounted in said punch holder tang seat, said punch received in said guide bore, a radial face formed on said punch holder tang and an opposing radial face on said punch holder body axially spaced therefrom, and composite stripper spring means interposed in the space between said radial faces and compressed between said radial faces, said composite spring means being composed of an annular array of sets of helical springs interposed between said radial faces, each of said spring sets including a larger diameter helical spring and a smaller diameter helical spring nested within said larger diameter helical spring, said sets of helical springs compressed together by advance of said punch holder tang in said punch holder body bore during a punching operation, and a retainer element fixed to said punch holder body above said punch holder tang to resist separating forces created by said composite stripper spring means.

2. The stripper arrangement according to claim 1 wherein each of said radial faces is formed with aligned pockets for receiving a respective one of said spring sets, each pocket comprised of a larger diameter counterbore and a smaller diameter counterbore each receiving an end of one of said larger diameter helical springs and one of said smaller diameter helical springs respectively.

3. The stripper arrangement according to claim 1 further including an end portion formed on a lower end of said punch holder body, and a stripper cap press fit on said lower end portion and having an end wall extending radially inward towards said punch.

4. The stripper arrangement according to claim 3 wherein said lower end portion has an O-ring disposed therein frictionally engaged with said stripper cap.

5. The stripper arrangement according to claim 4 wherein said stripper cap has an inner groove formed therein adapted to mate with said O-ring upon seating of said stripper cap, whereby a snap action seating is achieved.

6. The stripper arrangement according to claim 4 wherein said lower end portion has a threaded section formed thereon above said stripper cap and further including a removal ring threaded onto said threaded section, downward advance of said removal ring allowing said stripper cap to be forced off said end portion.

7. The stripper arrangement according to claim 3 wherein said lower end portion is formed with a counter-bore receiving a head portion of said punch, and further including a support ring disposed in said counterbore underlying and supporting said end wall of said stripper cap, and wherein said stripper cap is plastic.

8. A stripper arrangement for a punch holder, said punch holder including a punch holder tang having a tee head formed at an upper end of the punch holder for mating with a press ram tee slot, a punch holder body having a bore formed therein slidably receiving said punch holder tang, said punch holder tang formed with a punch mounting seat for mounting a punch, said punch holder body having a punch guide bore, a punch mounted in said punch holder tang seat, said punch slidably received in said guide bore, a radial face formed on said punch holder tang and an opposing radial face on said punch holder body axially spaced therefrom, and stripper spring means interposed in space between said radial faces and compressed between said radial faces, said spring means including a compressible element compressed together by advance of said punch holder tang in said punch holder body bore during a punching operation, a retainer element fixed to said punch holder body above said punch holder tang to resist separating forces created by said stripper spring means;

said punch holder body having a lower end portion, a stripper cap press fit over said end portion of said punch holder body to be held thereon by a frictional grip;

said lower end portion including a threaded section above said stripper cap; and a removal ring threaded onto said threaded section to be positioned above said stripper cap, whereby advance of said removal ring on said threaded section downwardly causes said removal ring to engage and push said stripper cap downwardly along said lower end portion of said punch holder body to thereby be forced off said lower end portion by overcoming said frictional grip.

9. A stripper arrangement for a punch holder adapted to mount a punch in a punch press, said punch holder including a punch holder tang having a tee head formed at an upper end of the punch holder for mating with a press ram tee slot, a punch holder body having a bore formed therein slidably receiving said punch holder tang, said punch holder tang formed with a punch mounting seat for mounting a punch, said punch holder body having a punch guide bore, a punch mounted in said punch holder tang seat, said punch said punch received in said guide bore, a radial face formed on said punch holder tang and an opposing radial face on said punch holder body axially spaced therefrom, and stripper spring means interposed in the space between said radial faces and compressed between said radial faces, said spring means compressed together by advance of said punch holder tang in said punch holder body bore during a punching operation, a retainer element fixed to said punch holder body above said punch holder tang to resist separating forces created by said stripper spring means;

said punch holder body having a lower end portion, and a molded plastic stripper cap mounted thereto, including an end wall extending radially inward across an end of said punch;

a flat metal insert molded into said end wall of said stripper cap stiffening said end wall, an opening through said end wall and said metal insert, said punch loosely fit to said opening in said end wall and said metal insert allowing said punch to move therethrough during a punching operation, said metal insert stiffening said end wall to resist deflection thereof as said punch is withdrawn.

10. A stripper arrangement for a punch holder, said punch holder including a punch holder tang having a tee head formed at an upper end of the punch holder for mating with a pres ram tee slot, a punch holder body having a bore formed therein slidably receiving said punch holder tang, said punch holder tang formed with a punch mounting seat for mounting a punch, said punch holder body having a punch guide bore, a punch mounted in said punch holder tang seat, said punch received in said guide bore, a radial face formed on said punch holder tang and an opposing radial face on said punch holder body axially spaced therefrom, and composite stripper spring means interposed in the space between the radial faces and compressed between said radial faces, said composite spring means being composed of an elastomeric cylinder disposed in the space between said radial faces, and an annular series of axial bores extending therethrough, and a helical spring disposed in each of said axial bores, both said elastomeric cylinder and said helical springs compressed together by advance of said punch holder tang in said punch holder body bore during a punching operation, and a retainer element fixed to said punch holder body above said punch holder tang to resist separating forces created by said composite stripper spring means.

* * * * *